US011501941B2

(12) United States Patent
Wang et al.

(10) Patent No.: US 11,501,941 B2
(45) Date of Patent: Nov. 15, 2022

(54) OVERLOAD PROTECTION SWITCH WITH REVERSE RESTART SWITCHING STRUCTURE

(71) Applicants: Yi-Hsiang Wang, Taoyuan (TW); I-Ying Wang, Taoyuan (TW)

(72) Inventors: Yi-Hsiang Wang, Taoyuan (TW); I-Ying Wang, Taoyuan (TW)

( * ) Notice: Subject to any disclaimer, the term of this patent is extended or adjusted under 35 U.S.C. 154(b) by 82 days.

(21) Appl. No.: 17/194,479

(22) Filed: Mar. 8, 2021

(65) Prior Publication Data

US 2022/0285119 A1 Sep. 8, 2022

(51) Int. Cl.

| | |
|---|---|
| ***H01H 73/14*** | (2006.01) |
| ***H01H 71/50*** | (2006.01) |
| ***H01H 21/20*** | (2006.01) |
| ***H01H 47/00*** | (2006.01) |

(52) U.S. Cl.

CPC ..... *H01H 73/14* (2013.01); *H01H 21/20* (2013.01); *H01H 47/002* (2013.01); *H01H 71/504* (2013.01)

(58) Field of Classification Search

CPC .... H01H 21/20; H01H 47/002; H01H 71/504; H01H 73/14

USPC ..... 337/79

See application file for complete search history.

(56) References Cited

U.S. PATENT DOCUMENTS

| | | | | |
|---|---|---|---|---|
| 5,694,106 | A * | 12/1997 | Wang | H01L 21/67109 337/72 |
| 6,075,436 | A * | 6/2000 | Hsu | H01H 73/26 337/365 |
| 10,937,602 | B2 * | 3/2021 | I | H01R 13/03 |
| 2017/0047180 | A1 * | 2/2017 | Wang | H01H 37/76 |
| 2017/0148601 | A1 * | 5/2017 | Wang | H01H 71/20 |
| 2017/0148602 | A1 * | 5/2017 | Wang | H01H 37/761 |
| 2019/0066887 | A1 * | 2/2019 | Wang | H02H 9/041 |

* cited by examiner

*Primary Examiner* — Kevin J Comber

(74) *Attorney, Agent, or Firm* — Rosenberg, Klein & Lee

(57) ABSTRACT

An overload protection switch with reverse restart switching structure, particularly to one that has a molded-case circuit breaker which adding a lampshade parallel stagnation position for overload indication, and when resetting, needs to press back to the RESET for reconfirmation; due to the stagnation position and reverse restart structure, it can avoid repeating the reset action, preventing the reduction of the life of the overload protection switch and repeated exposure or the misjudgment and then resetting of electrical products that have been overloaded and tripped and then overload again then results in causing dangerous; also, the lampshade can be completely tripped even when the lampshade is suppressed, and prevent the danger of repeated tripping during overload.

7 Claims, 16 Drawing Sheets

OVERLOAD PROTECTION SWITCH WITH REVERSE RESTART SWITCHING STRUCTURE

BACKGROUND OF THE INVENTION

1. Field of the Invention

The present invention relates to an overload protection switch with reverse restart switching structure, particularly to one that has an overload protection and three step fool-proof design molded-case circuit breaker.

2. Description of the Related Art

Low-voltage circuit breaker, Europe and America call molded-case circuit breaker (MCCB) is a low-voltage overcurrent protection circuit breaker. Compared with miniature circuit breaker (MCB), molded-case circuit breaker has a larger rated current and breaking capacity, in Taiwan and Japan is called non-fuse circuit breaker (NFB), another product with leakage protection is classified as electricity leakage circuit breaker (ELCB), and for products with relatively small capacity, it is called MCB Or ELB. Usually, MCCB and ELCB circuit breakers are used for large breaking capacity, commonly known as industrial type. MCB and ELB are used for small interruption capacity, commonly known as household lamp plug-in circuit breakers, their function is mainly to protect equipment and circuit safety. When an overload or short circuit accident occurs, it will trip and isolate the power supply. If it is ELCB or ELB, it has leakage protection function. Circuit breaker is the main isolating switch for protecting equipment and circuit safety in the world, and it is also the most common product in the world.

FIGS. 1A and 1B disclose a conventional overcurrent protection switch 10 comprises a housing 11 with a lampshade 12 on the top, a first terminal 12*a*, a second terminal 12*b*, a third terminal 12*c* separately arranged at the bottom for providing power for neon lamp 15. The first terminal 12*a* has a bimetal plate 13 and a first contact 131; the second terminal 12*b* has a second contact 121 corresponding to the first contact 131. The moving element 14 has one end linking the bottom of the lampshade 12 and the other linking the moving terminal of the bimetal plate 13, whereby the pressing of the lampshade 12 actuates the first contact 131 connecting to the second contact 121 and therefore turns on the device; while overcurrent occurs, the bimetal plate 13 deforms due to high degree of temperature and disconnects the first and second contact 131, 121, turning off the device so as to form an overcurrent protection switch 10. Such structure can be found in Taiwan patent applications No. 540811, 367091, 320335, 262168, and 208384.

However, above mentioned conventional overcurrent protection switch 10 does not have the multiple step fool-proof design that molded-case circuit breaker has, due to the use of a cyclic tripping structure, when the lampshade 12 is pressed or stuck, the bimetal plate 13 is repeatedly connected and disconnected (ON↔OFF), repeated overloads resulting in loss of overload protection function, so the service life and use safety need to be improved.

SUMMARY OF THE INVENTION

A primary object of the present invention is to provide an overload protection switch with reverse restart switching structure that achieves making small overcurrent protection switch has multiple step fool-proof design like MCCB had and design with an unobstructed complete separation and tripping structure, when the lampshade is blocked by external force, the binary alloy conductive plate can still complete a single tripping action smoothly, and it needs to be restarted by foolproof operation, which has the effect of increasing the service life and improving the safety of use.

To achieve the objects mentioned above, the present invention comprises a housing having a lampshade arranged atop thereof, and a first terminal and a second terminal arranged at the bottom section; the first terminal is connected to a binary alloy conductive plate, the binary alloy conductive plate extends a spring leaf having a first connecting point, and the second terminal having a second connecting point on the surface of an upper section thereof corresponding to the first connecting point; a moving rod linking up a pivot hole at the bottom of the lampshade with one end and the binary alloy conductive plate with the other end for the first connecting point to contact the second connecting point, when the pivot hole is pushed inward, consequently achieve conducting state, and for the first connecting point to detach from the second connecting point when current overload occurs and the binary alloy conductive plate is deformed due to high temperature, consequently achieve non conducting state, so as to form an overcurrent protection switch; characterized in that: the moving rod includes: a horizontal rod arranged at the upper section of the main body to set through the pivot hole of the lampshade; a first brake plate arranged at the middle section of the moving rod and extended inward; a second brake plate which extended inward and bended is arranged at the middle section of the moving rod and lower than the first brake plate, making the second brake plate form a forward guiding surface above the second brake plate and a backward guiding surface below the second brake plate, so as to form a dislocation area between the first brake plate and the forward guiding surface of the second brake plate; a third brake plate which extended inward and bended is arranged at the lower section of the moving rod, so as to form a normal operating area between the backward guiding surface of the second brake plate and the third brake plate; the inward extended distance from the moving rod of the first brake plate is defined as W1, the inward extended distance from the moving rod of the second brake plate is defined as W2, the inward extended distance from the moving rod of the third brake plate is defined as W3, and both W3 and W1 is longer than W2; the housing corresponding to the inner side of the moving rod has three inner surfaces with different height, from top to bottom are a first inner surface, a second inner surface, a third inner surface, wherein the first inner surface is a V shape concave surface, the second inner surface is a flat surface, and the third surface is a shrank inclined surface; on the other end of the lampshade which corresponding to the pivot hole having a stopping member extend downward; an elastic leaf arranged above the second terminal and outside the stopping member, for providing the lampshade an elastic stopping force, let the lampshade can be fixed at the tail end of the SET while switching to the SET, and make sure the moving rod stayed at the bottom of the inner side of the housing and had the largest rotate angle; and when the lampshade is pressed as ON/OFF switch, the moving rod is droved to rise and fall in inclined way, and makes the curve of the lower section of the moving rod to move along the second inner surface and the third inner surface; the three step switching operation involves the following steps:

a). when the lampshade is pressed to ON position, the curve of the lower section of the moving rod move along the second inner surface to the third inner surface, making the backward guiding surface of the second brake plate push from up to down the movable end of the binary alloy conductive plate which placed at the normal operating area to deform it reversely, and further make the spring leaf flip upward and make the first connecting point contact the second connecting point to achieve conducting state;

b). when the lampshade is pressed to OFF position, the curve of the lower section of the moving rod move along the third inner surface to the second inner surface, the third inner surface pull from down to up the movable end of the binary alloy conductive plate to deform it reversely, and further make the spring leaf flip downward and make the first connecting point detach from the second connecting point to achieve non conducting state;

c). when the first connecting point of the binary alloy conductive plate contacting the second connecting point to achieve conducting state, the curve of the lower section of the moving rod is located at the third inner surface, and the second brake plate is moved to outermost by the elastic force of the elastic leaf making the moving rod have the largest rotated angle for the second brake plate being vertical, so as to evade stopping place of the movable end of the binary alloy conductive plate; therefore, when the overvoltage occurred, the binary alloy conductive plate will be deformed due to high temperature and further flip upward, and skipping the second brake plate directly push the first brake plate for making the moving rod move upward and then driving the lampshade set as BREAK status, meanwhile, the movable end of the binary alloy conductive plate is located at the dislocation area which between the first brake plate and the second brake plate;

d). finally, press the OFF end of the lampshade to do the RESET action making the moving rod move upward for the curve of the lower section of the moving rod move to the first inner surface, by the backward guiding surface of the second brake plate can move upward smoothly and slip through the movable end of the binary alloy conductive plate and back to the normal operating area below the second brake plate, so as to making the lampshade enable switch normally between ON and OFF.

With the feature disclosed above, the present invention has a first brake plate of the moving rod arranged on the second brake plate, and a third brake plate formed at the curve of the lower section of the moving rod; the outwardly deviated moving rod is formed to press outward and match the position of the housing and has three inner side surface with different height to achieve three step fool proof feature; and further achieve adding a lampshade parallel stagnation position for overload indication, and when resetting, needs to press back to the RESET (off end) for reconfirmation, and make the binary alloy conductive plate reorder in the correct order and then press the SET (on end) to restart; during overload, due to the stagnation position and reverse restart structure (fool proof), it can avoid repeating the reset action (set) of the short-circuited electrical appliance without removing the short circuit, preventing the reduction of the life of the overload protection switch and repeated exposure (the test specification is 3 short-circuit tests) or the misjudgment and then resetting of electrical products that have been overloaded and tripped and then overload again then results in causing dangerous; also, the lampshade can be completely tripped even when the lampshade is suppressed, and prevent the danger of repeated tripping during overload.

BRIEF DESCRIPTION OF THE DRAWINGS

FIG. 5B is a zoom in view showing the second brake plate moves from up to down to push the movable end of the binary alloy conductive plate to ON;

DETAILED DESCRIPTION OF THE PREFERRED EMBODIMENT

Figure 1A:
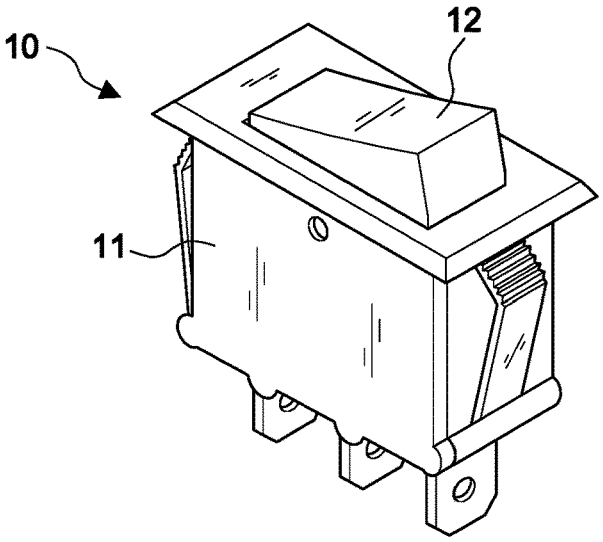
FIG.1A PRIOR ART
FIG. 1A is a perspective view of an overcurrent protection switch according to the prior art.
Figure 1B:
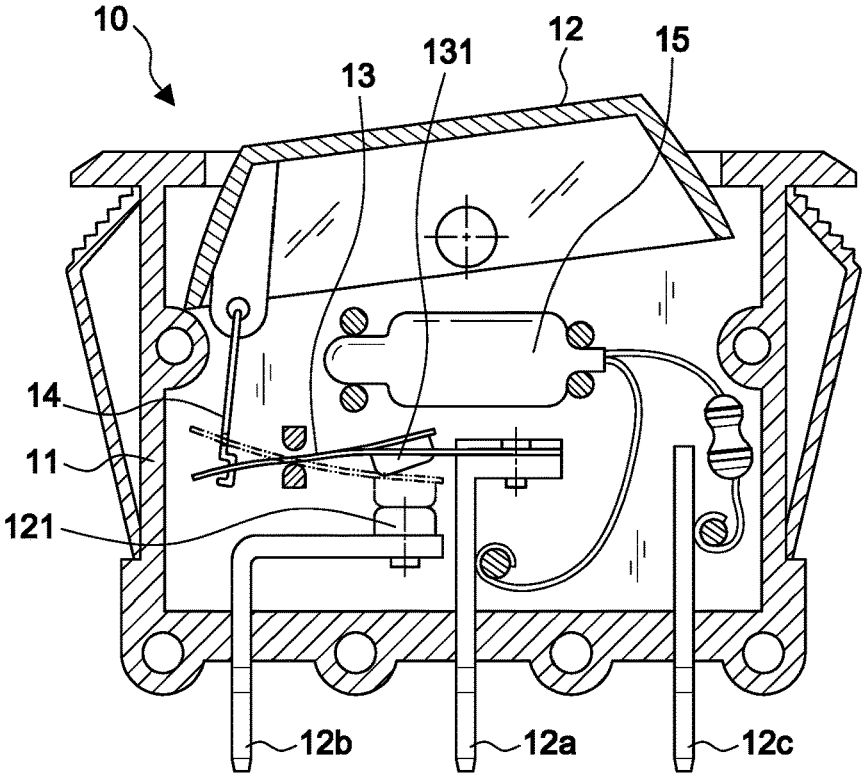
FIG.1B PRIOR ART
FIG. 1B is a section view of an overcurrent protection switch according to the prior art.

Referring to FIGS. 2-8B, the circuit breaker 30 of the present invention in preferred embodiment includes a housing 31 having a lampshade 32 arranged atop thereof, below the lampshade 32 further includes a neon lamp 34, and a first terminal 40 and a second terminal 50 arranged at the bottom section, in this embodiment further having a third terminal 60, but not limited to such application. The first terminal 40 is connected to a binary alloy conductive plate 41, the inner side of the movable end 411 of the binary alloy conductive plate 41 extends a spring leaf 42 the movable end 411, above the movable end 411 having a first connecting point 421, and the second terminal 50 having a second connecting point 511 on the surface of an upper section 51 thereof corresponding to the first connecting point 421; in this embodiment, the housing 31 further includes a side cover 311.

Figure 3A:
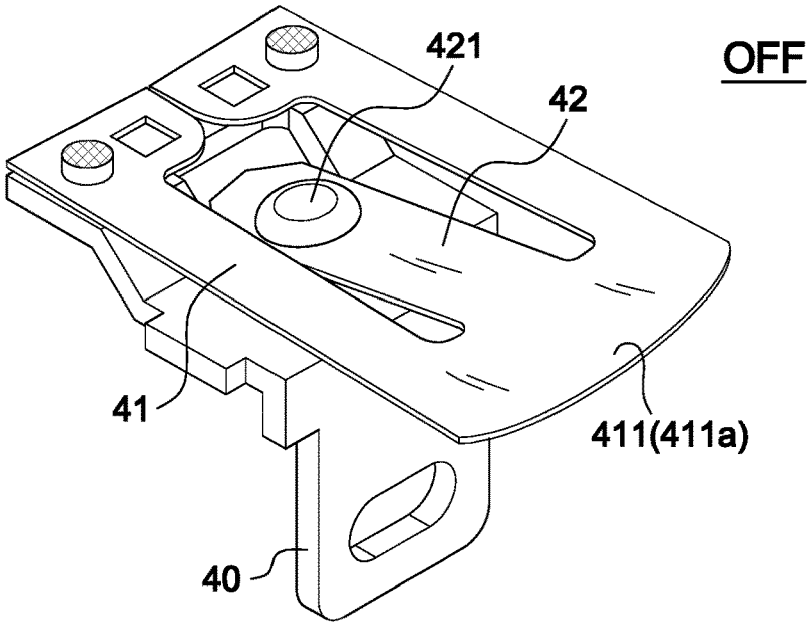
FIG. 3A is a perspective view of the preferred embodiment of the present invention while the binary alloy conductive plate is curved upward.
Figure 3B:
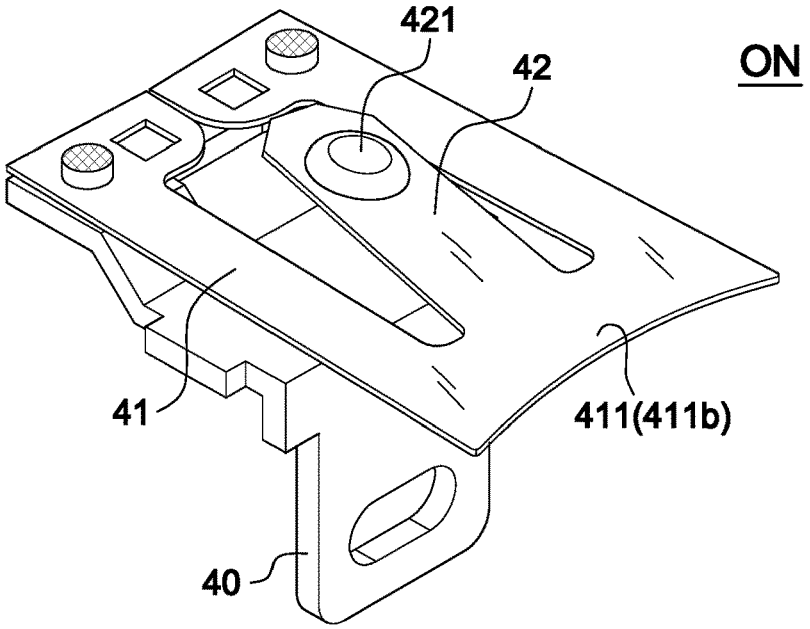
FIG. 3B is a perspective view of the preferred embodiment of the present invention while the binary alloy conductive plate is curved downward.

FIG. 3A is a perspective view showing the movable end 411 of the binary alloy conductive plate 41 which is curved in up concave arc shape 411*a*, for making the spring leaf 42 to flip downward; FIG. 3B is a perspective view showing the movable end 411 of the binary alloy conductive plate 41 which is curved in down concave arc shape 411*b*, for making the spring leaf 42 to flip upward.

A moving rod 33 linking up a pivot hole 321 at the bottom of the lampshade 32 with one end and the binary alloy conductive plate 41 with the other end for the first connecting point 421 to contact the second connecting point 511, when the pivot hole 321 is pushed inward, consequently achieve conducting state (ON, SET end), and for the first connecting point 421 to detach from the second connecting point 511 when current overload occurs and the binary alloy conductive plate 41 is deformed due to high temperature, consequently achieve non conducting state (OFF), so as to form an overcurrent protection switch.

Figure 2:
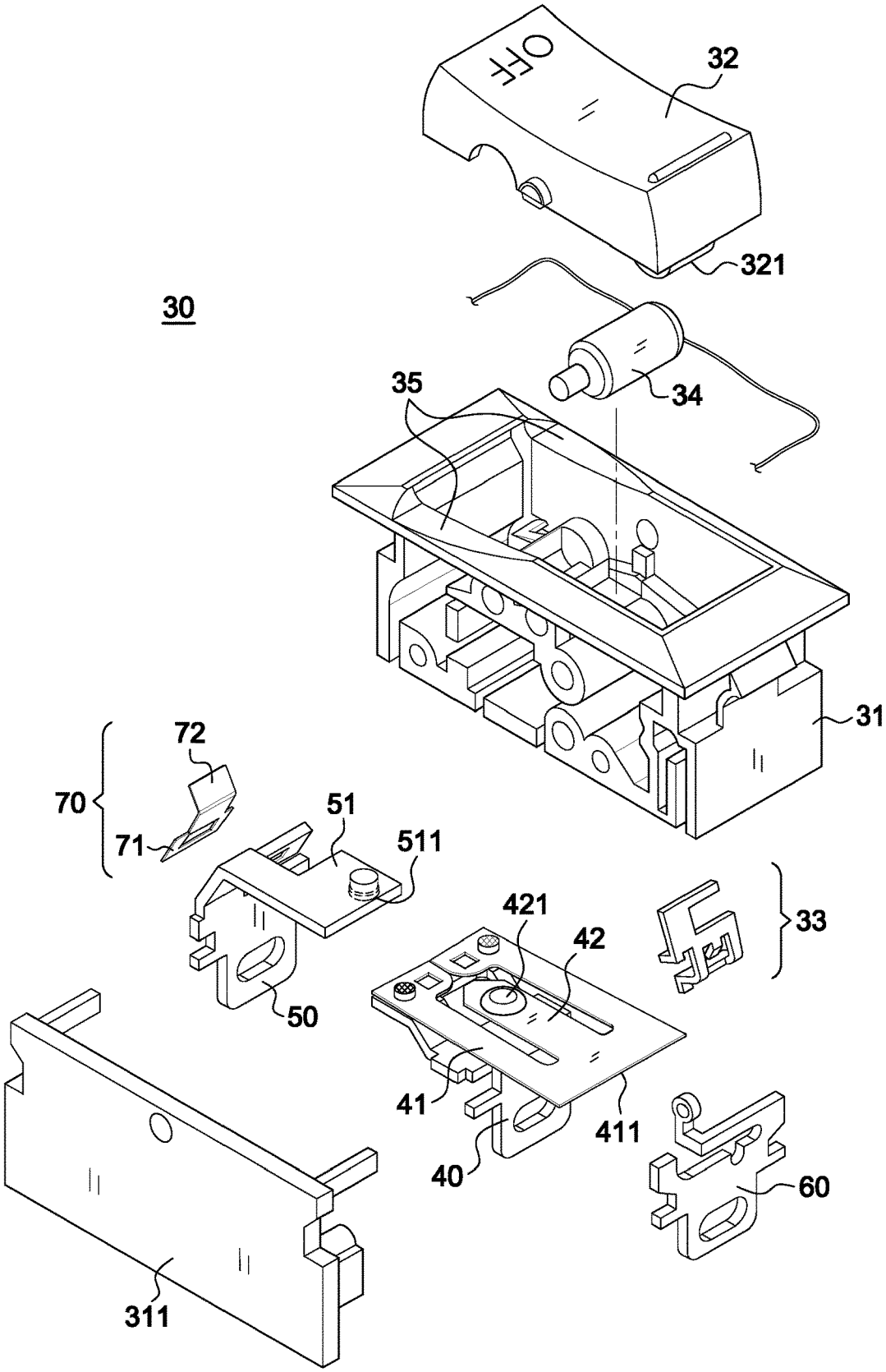
FIG. 2 is an exploded view of the preferred embodiment of the present invention.
Figure 3C:
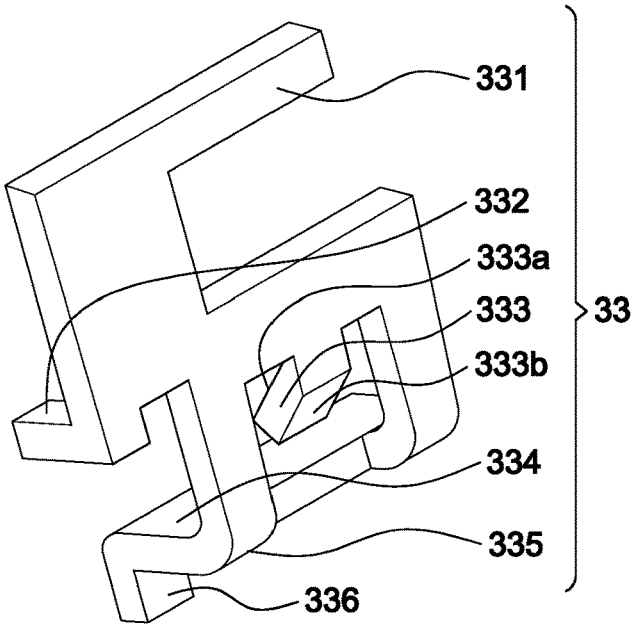
FIG. 3C is a perspective view of the moving rod.
Figure 3D:
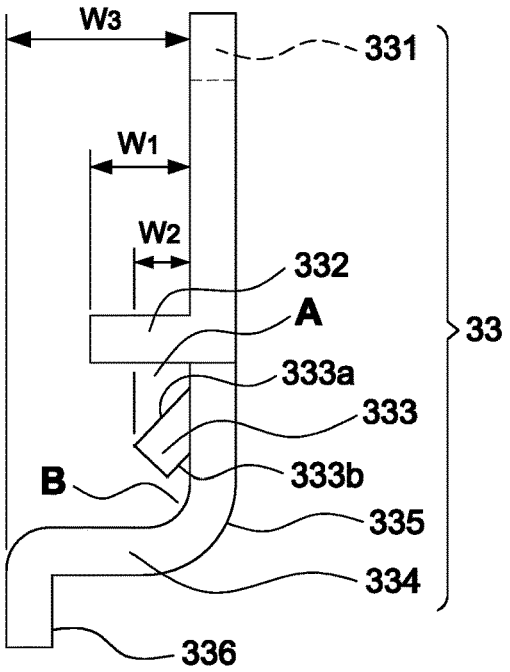
FIG. 3D is a side view of the moving rod.

Referring to FIG. 2, FIG. 3C and FIG. 3D, the main feature of the present invent is: the moving rod 33 includes: a horizontal rod 331 arranged at the upper section 51 of the main body 71 to set through the pivot hole 321 of the lampshade 32; a first brake plate 332 arranged at the middle section of the moving rod 33 and extended inward; a second brake plate 333 which extended inward and bended is arranged at the middle section of the moving rod 33 and lower than the first brake plate 332, making the second brake plate 333 form a forward guiding surface 333*a* above the second brake plate 333 and a backward guiding surface 333*b* below the second brake plate 333, so as to form a dislocation area A between the first brake plate 332 and the forward guiding surface 333*a* of the second brake plate 333; a third brake plate 334 which extended inward and bended is arranged at the lower section of the moving rod 33, so as to form a normal operating area B between the backward guiding surface 333*b* of the second brake plate 333 and the third brake plate 334. In this embodiment, at the bottom of the third brake plate 334 has an extended pin 336; the inward extended distance from the moving rod 33 of the first brake plate 332 is defined as W1, the inward extended distance from the moving rod 33 of the second brake plate 333 is defined as W2, the inward extended distance from the moving rod 33 of the third brake plate 334 is defined as W3, and both W3 and W1 is longer than W2.

Figure 5A:
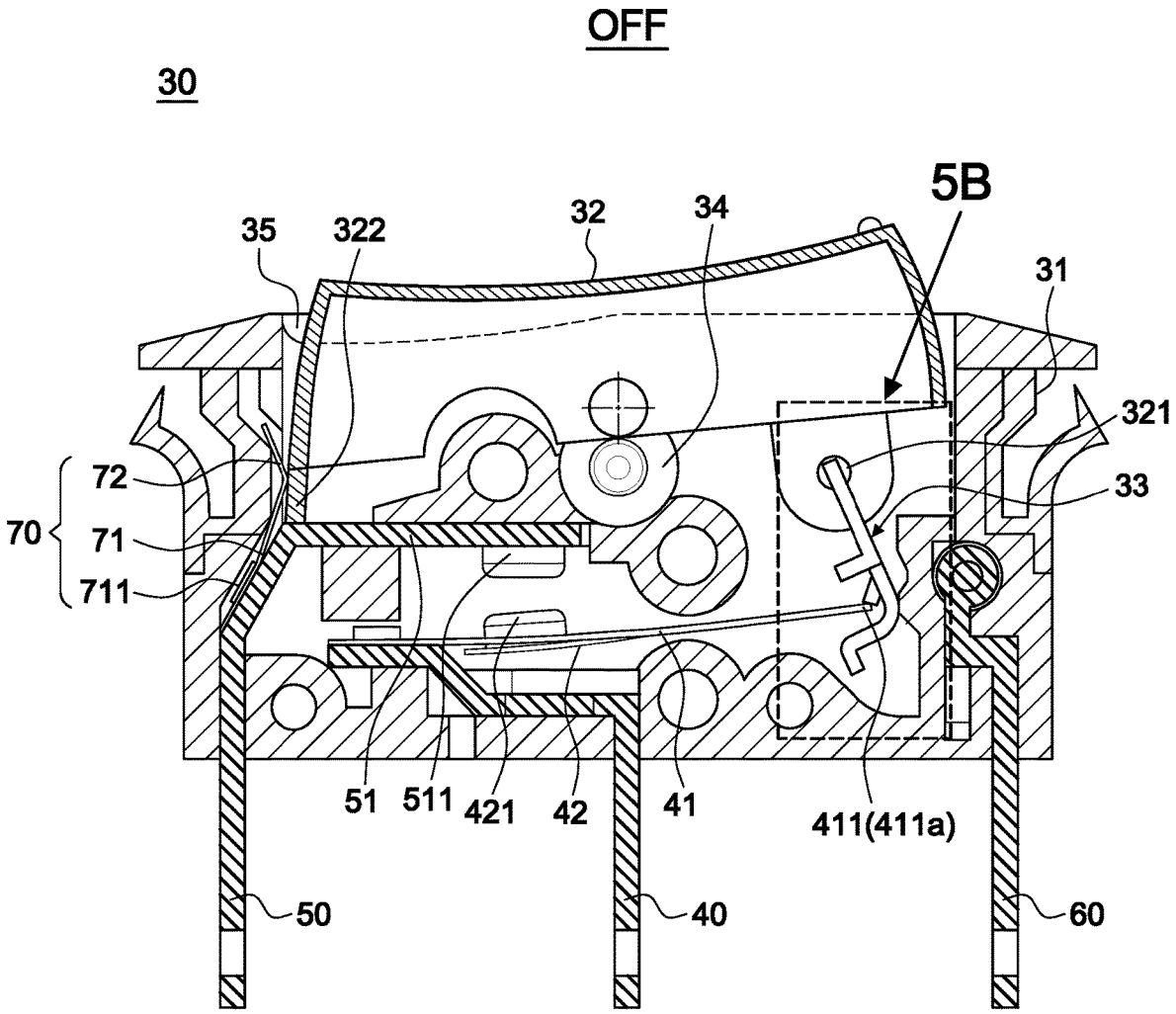
FIG. 5A is a section view of the preferred embodiment of the present invention, in OFF status.
Figure 5B:
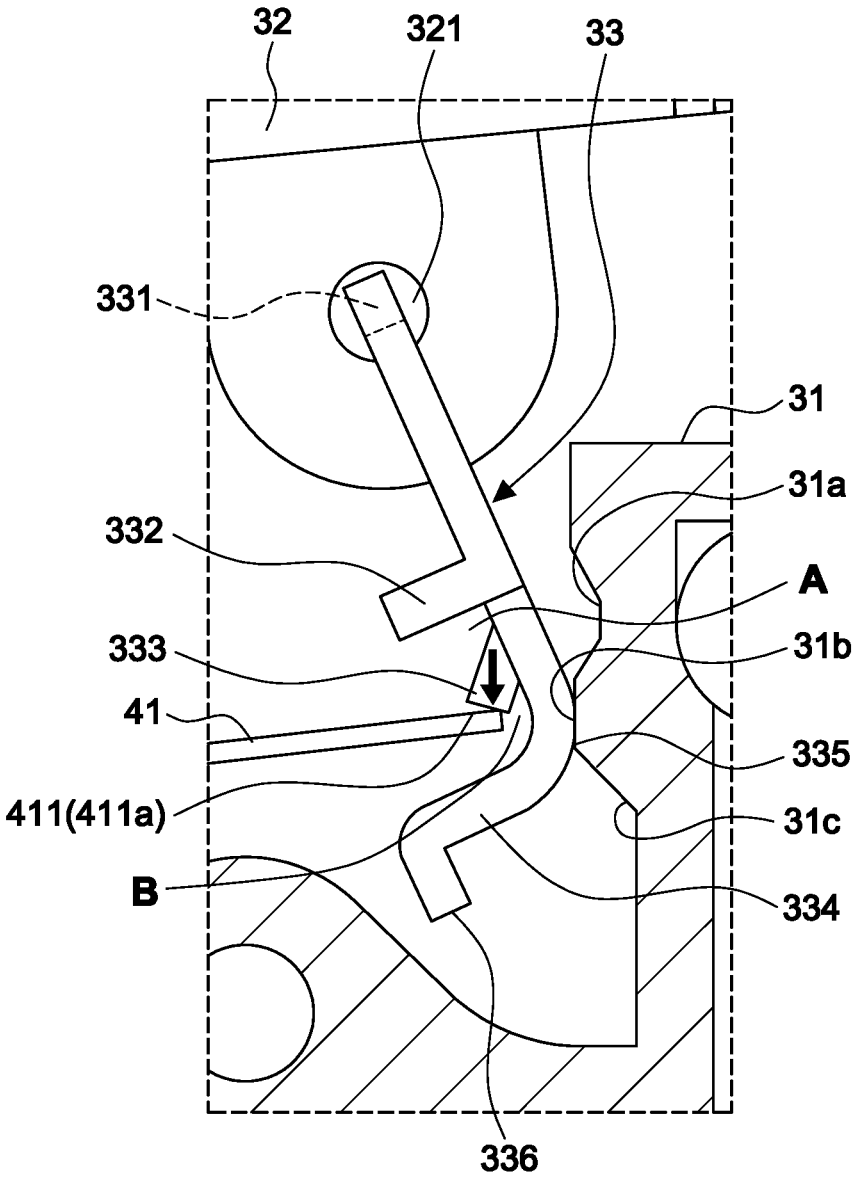
Figure 5C:
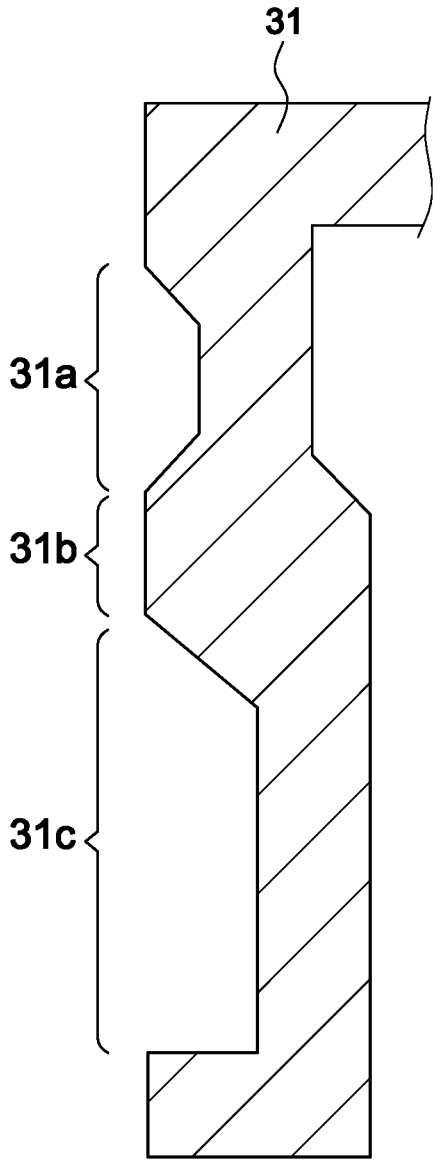
FIG. 5C is a zoom in view of three different height inner surface in FIG. 5B.
Figure 5D:
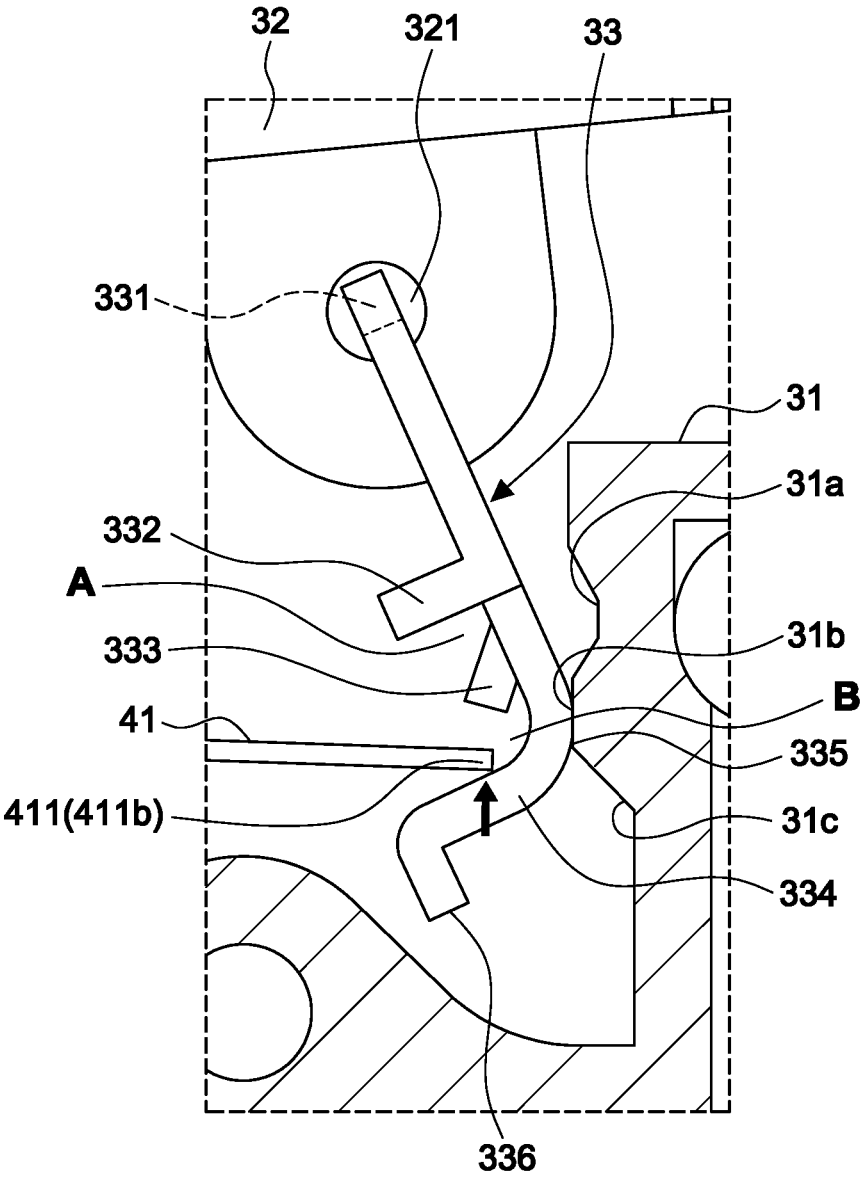
FIG. 5D is a zoom in view showing the third brake plate pulls the movable end of the binary alloy conductive plate to OFF.

Referring to FIG. 5C, the housing 31 corresponding to the inner side of the moving rod 33 has three inner surfaces with different height, from top to bottom are a first inner surface 31*a*, a second inner surface 31*b*, a third inner surface 31*c*, wherein the first inner surface 31*a* is a V shape concave surface, the second inner surface 31*b* is a flat surface, and the third surface is a shrank inclined surface.

Figure 3E:
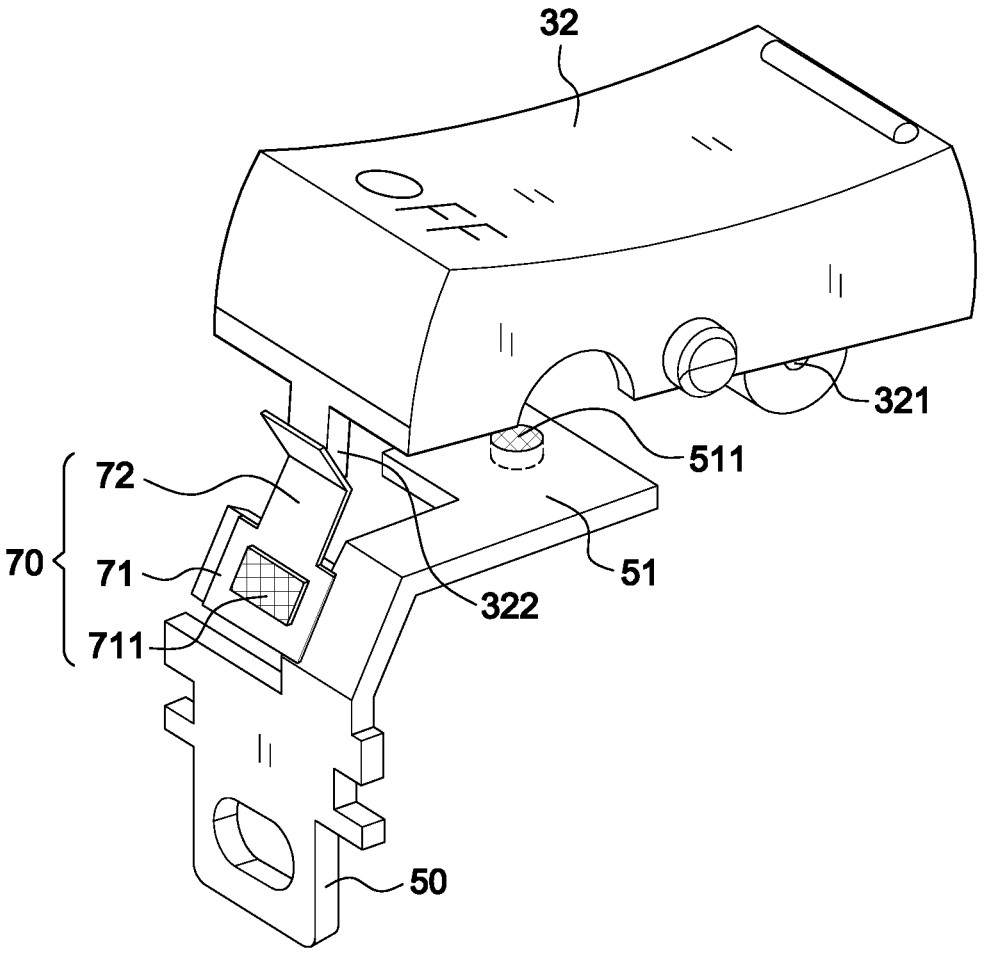
FIG. 3E is a perspective view of the elastic leaf and the lampshade.
Figure 4:
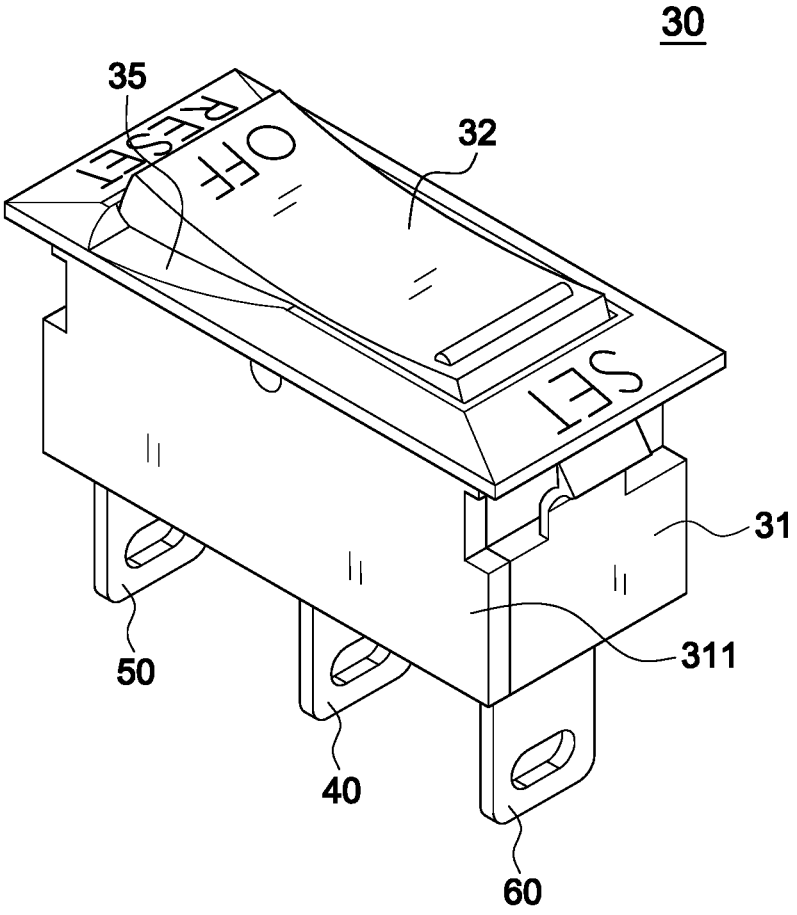
FIG. 4 is a perspective view of the preferred embodiment of the present invention.

On the other end of the lampshade 32 which corresponding to the pivot hole 321 having a stopping member 322 extend downward; an elastic leaf 70 arranged above the second terminal 50 and outside the stopping member 322, for providing the lampshade 32 an elastic stopping force, let the lampshade 32 can be fixed at the tail end of the SET while switching to the SET, and make sure the moving rod 33 stayed at the bottom of the inner side of the housing 31, which is at the third inner surface 31C; As FIG. 3E showing, the elastic leaf 70 include a main body 71 and an elastic contact end 72 over the main body 71, and the elastic contact end 72 is arranged outside the stopping member 322, but not limited to such application. The elastic stopping force make it be fixed outside the bottom of the tail end (SET) is also feasible.

In this embodiment, at the OFF end of the housing 31 having a concave arc surface 35 for allowing the user to press down the lampshade 32 to the RESET position.

Figure 6A:
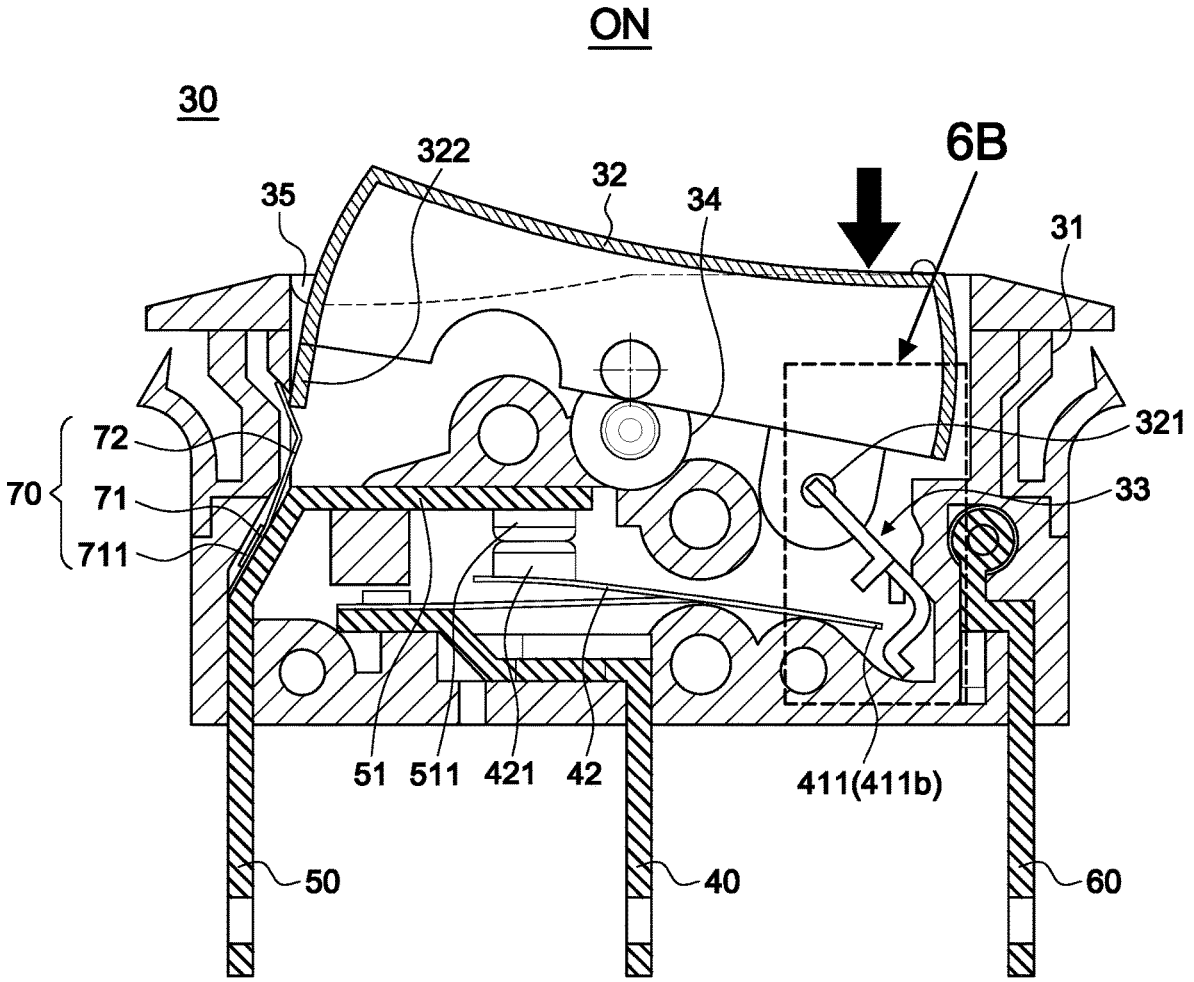
FIG. 6A is a section view of the preferred embodiment of the present invention, in ON status.
Figure 6B:
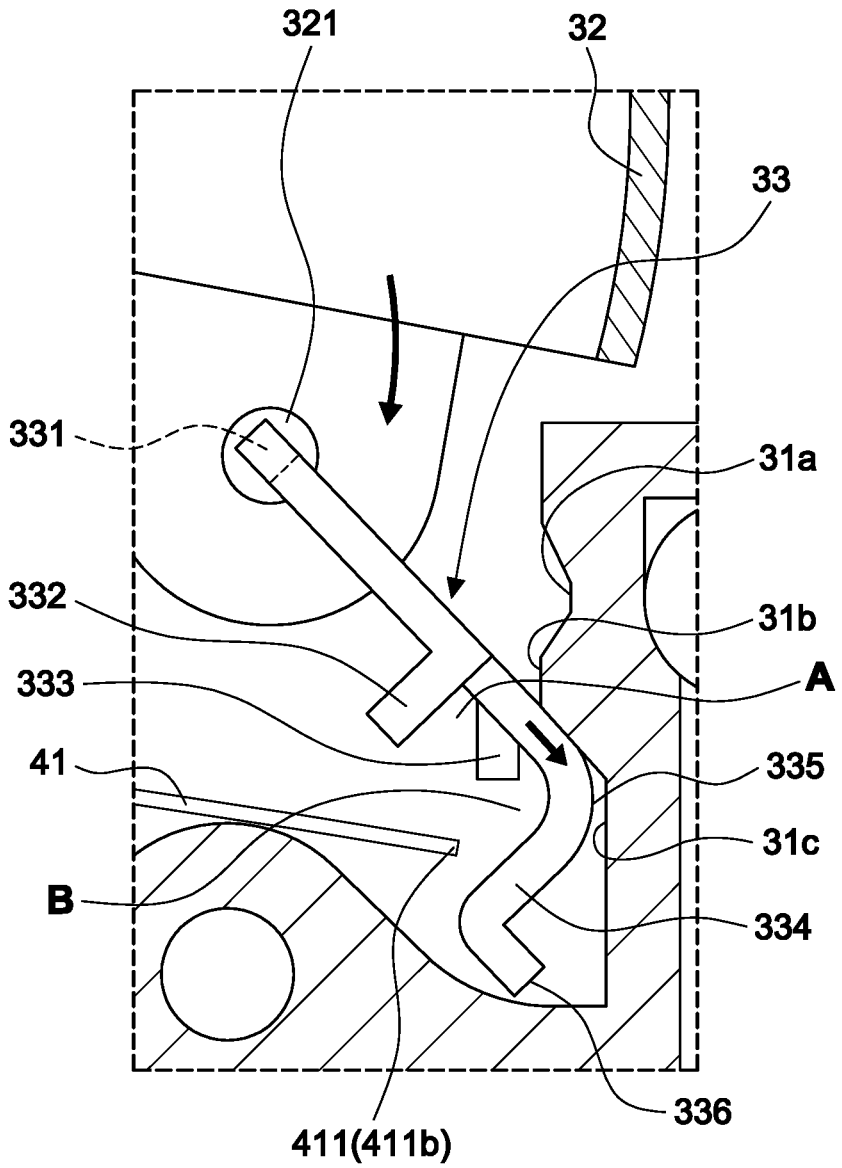
FIG. 6B is a zoom in view of the 6B area in FIG. 6A.
Figure 7A:
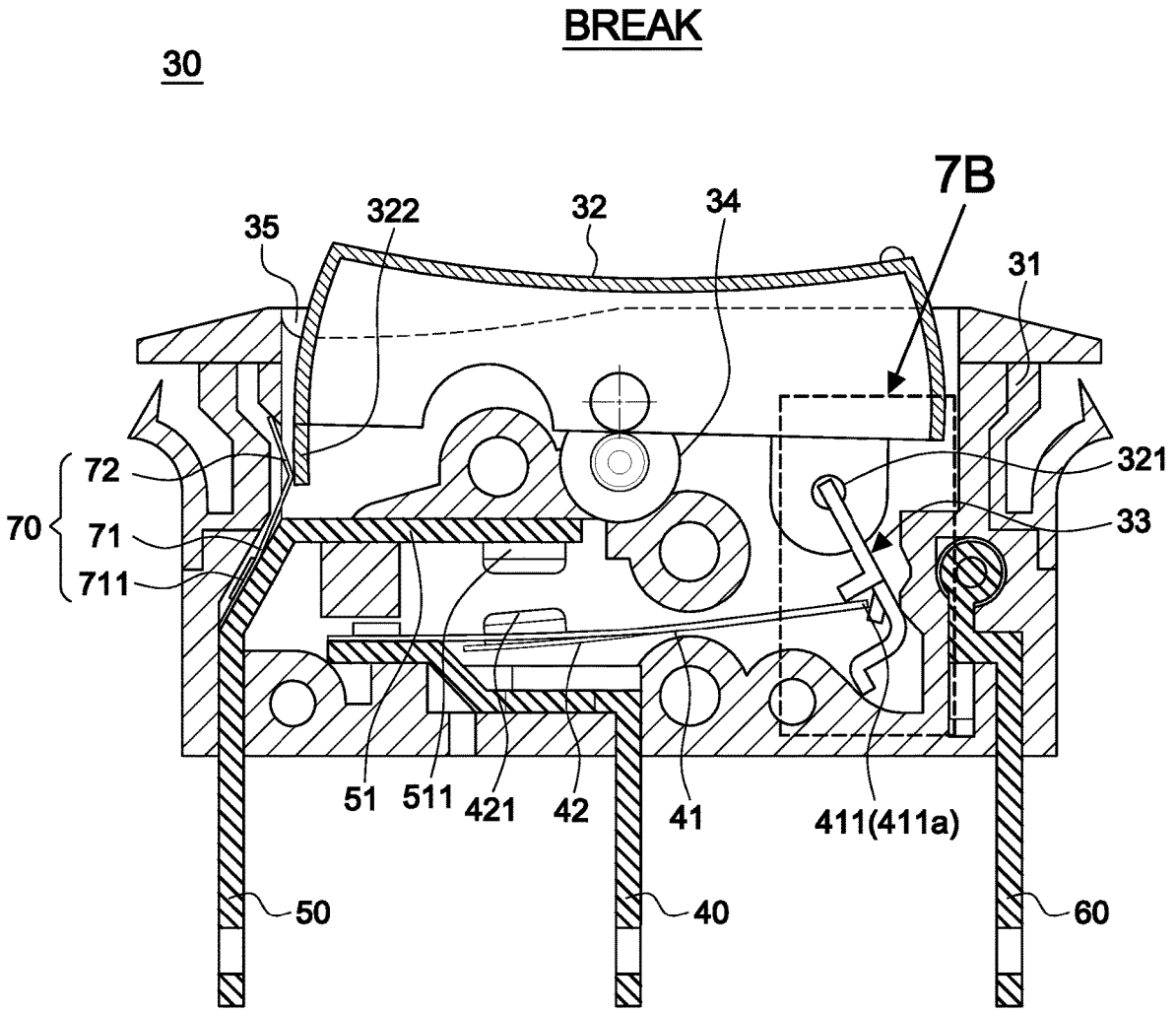
FIG. 7A is a section view of the preferred embodiment of the present invention, in BREAK status.
Figure 7B:
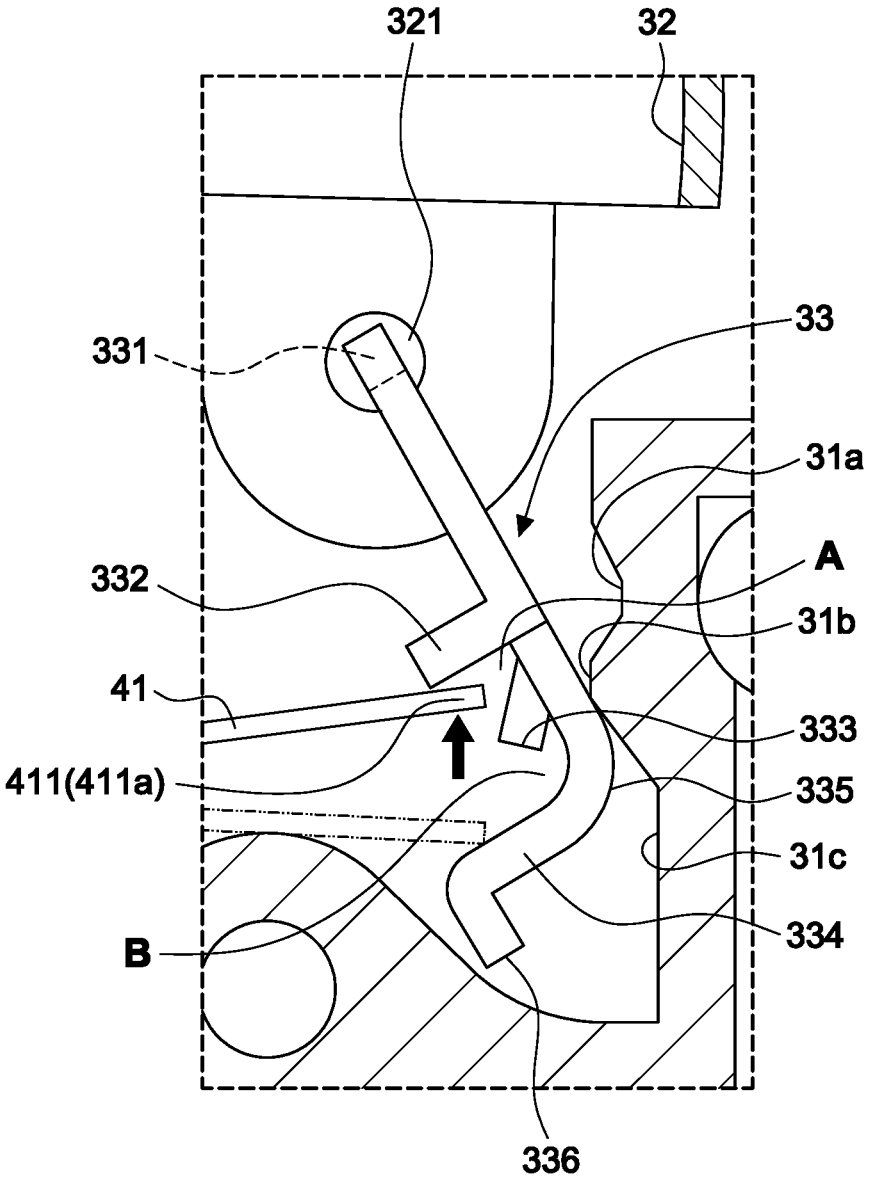
FIG. 7B is a zoom in view of the 7B area in FIG. 7A.
Figure 8A:
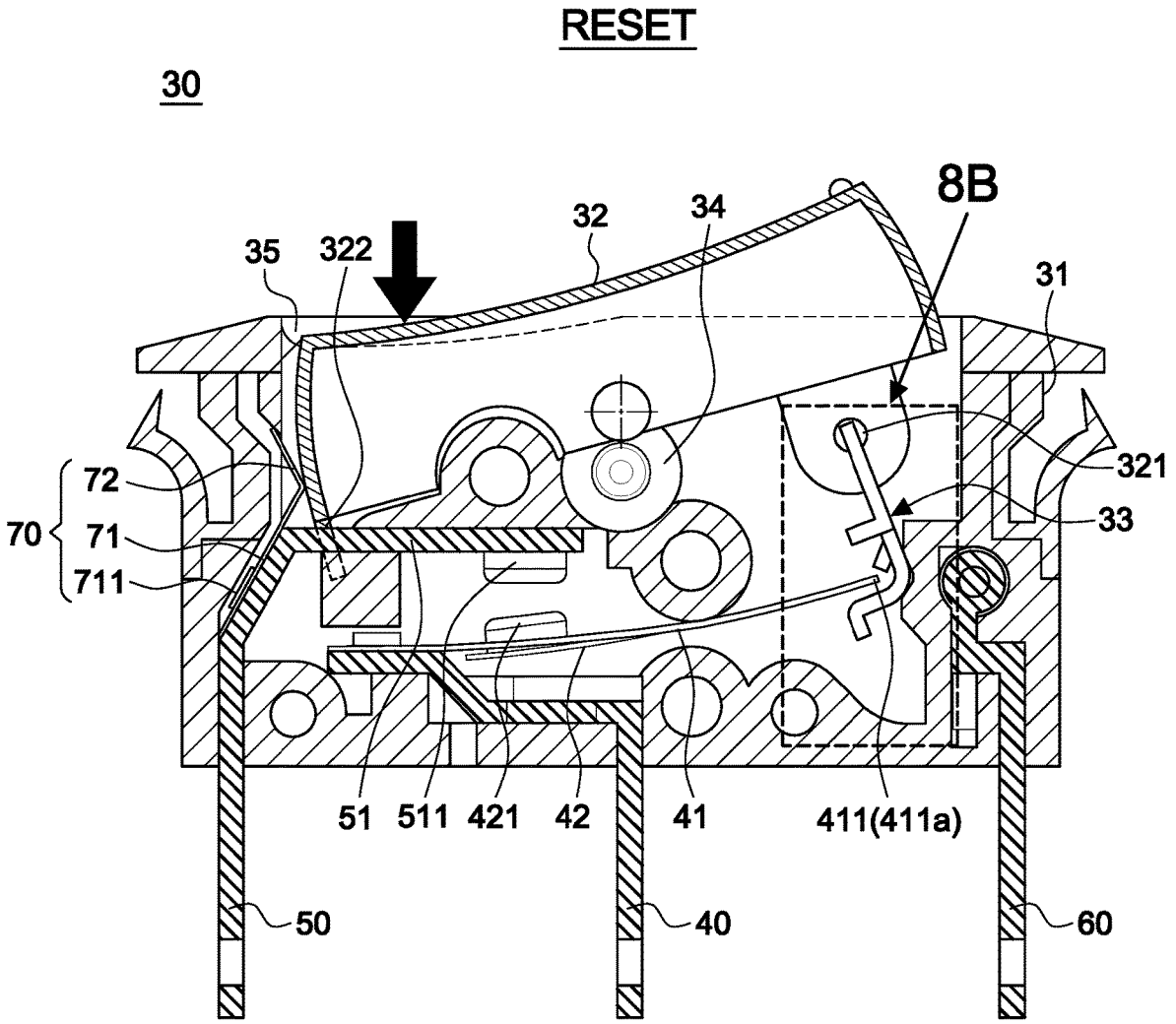
FIG. 8A is a section view of the preferred embodiment of the present invention, in RESET status.
Figure 8B:
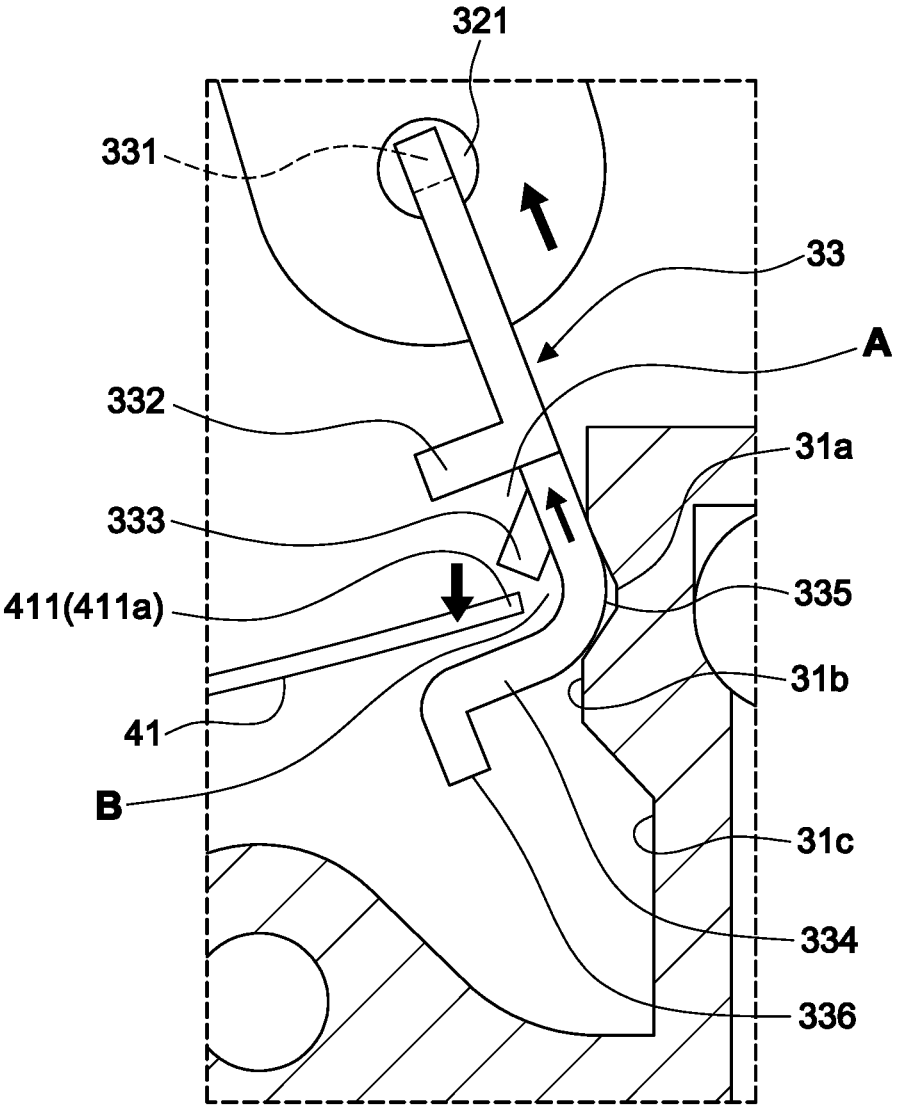
FIG. 8B is a zoom in view of the 8B area in FIG. 8A.

Whereby when the lampshade 32 is pressed as ON/OFF switch, the moving rod 33 is droved to rise and fall in inclined way, and makes the curve 335 of the lower section of the moving rod 33 to move along the second inner surface 31*b* and the third inner surface 31*c*; the three step switching operation involves the following steps:

a). when the lampshade 32 is pressed to ON position, the curve 335 of the lower section of the moving rod 33 move along the second inner surface 31*b* to the third inner surface 31*c*, from the position in FIG. 5B to the position in FIG. 6B, making the backward guiding surface 333*b* of the second brake plate 333 push from up to down the movable end 411 of the binary alloy conductive plate 41 which placed at the normal operating area B to deform it reversely, and further make the spring leaf 42 flip upward and make the first connecting point 421 contact the second connecting point 511 to achieve conducting state;

b). when the lampshade 32 is pressed to OFF position, the curve 335 of the lower section of the moving rod 33 move along the third inner surface 31*c* to the second inner surface 31*b*, from the position in FIG. 6B to the position in FIG. 5B, the third brake plate 334 pull from down to up the movable end 411 of the binary alloy conductive plate 41 to deform it reversely, and further make the spring leaf 42 flip downward and make the first connecting point 421 detach from the second connecting point 511 to achieve non conducting state;

c). when the first connecting point 421 of the binary alloy conductive plate 41 contacting the second connecting point 511 to achieve conducting state, the curve 335 of the lower section of the moving rod 33 is located at the third inner surface 31*c*, and the second brake plate 333 is moved to outermost by the elastic force of the elastic leaf 70 making the moving rod 33 have the largest rotated angle for the second brake plate 333 being vertical, so as to evade stopping place of the movable end 411 of the binary alloy conductive plate 41; therefore, when the overvoltage occurred, the binary alloy conductive plate 41 will be deformed due to high temperature and further flip upward, and skipping the second brake plate 333 directly push the first brake plate 332 for making the moving rod 33 move upward, from the position in FIG. 6B to the position in FIG. 7B, and then driving the lampshade 32 set as BREAK status, meanwhile, the movable end 411 of the binary alloy conductive plate 41 is located at the dislocation area A which between the first brake plate 332 and the second brake plate 333;

d). finally, press the OFF end of the lampshade 32 to do the RESET action making the moving rod 33 move upward for the curve 335 of the lower section of the moving rod 33 move to the first inner surface 31*a*, by the forward guiding surface 333*a* of the second brake plate 333 can move upward smoothly and slip through the movable end 411 of the binary alloy conductive plate 41 and back to the normal operating area B below the second brake plate 333, from the position in FIG. 7B to the position in FIG. 8B, so as to making the lampshade 32 enable switch normally between ON and OFF.

With the feature disclosed above, the present invention has a first brake plate 332 of the moving rod 33 arranged on the second brake plate 333, and a third brake plate 334 formed at the curve 335 of the lower section of the moving rod 33; the outwardly deviated moving rod 33 is formed to press outward and match the position of the housing 31 and has three inner side surface with different height 31*a*, 31*b* and 31*c* to achieve three step fool proof feature; and further achieve adding a lampshade 32 parallel stagnation position for overload indication, and when resetting, needs to press back to the RESET (OFF end) for reconfirmation, and make the binary alloy conductive plate 41 reorder in the correct order and then press the SET (ON end) to restart; during overload, due to the stagnation position and reverse restart structure (fool proof), it can avoid repeating the reset action (set) of the short-circuited electrical appliance without removing the short circuit, preventing the reduction of the life of the overload protection switch and repeated exposure (the test specification is 3 short-circuit tests) or the misjudgment and then resetting of electrical products that have been overloaded and tripped and then overload again then results in causing dangerous; also, the lampshade 32 can be completely tripped even when the lampshade is suppressed, and prevent the danger of repeated tripping during overload.

Although particular embodiments of the invention have been described in detail for purposes of illustration, various modifications and enhancements may be made without departing from the spirit and scope of the invention. Accordingly, the invention is not limited except as by the appended claims.

What is claimed is:

1. An overload protection switch with a reverse restart switching structure, comprising:

a housing having a lampshade disposed at an upper end thereof, and a first terminal and a second terminal arranged at a bottom section; the first terminal is connected to a binary alloy conductive plate, the binary alloy conductive plate has a spring leaf with a first connecting point, and the second terminal has a second connecting point on a surface of an upper section thereof disposed in correspondence with the first connecting point;

a moving rod linking a pivot hole at a bottom of the lampshade with one end and the binary alloy conductive plate with an opposing end thereof for the first connecting point to contact the second connecting point responsive to the pivot hole being pushed inward, to thereby achieve a conducting state (ON), and the first connecting point disconnecting from the second connecting point responsive to occurrence of a current overload wherein the binary alloy conductive plate deforms due to high temperature, and thereby achieving a nonconducting state (OFF), to thereby form an overcurrent protection switch; wherein:

the moving rod includes: a horizontal rod arranged at the upper section of the second terminal to pass into the pivot hole of the lampshade, a first brake plate arranged at a middle section of the moving rod and extending inwardly therefrom, a second brake plate extending inwardly from the middle section of the moving rod and being spaced below the first brake plate extending angularly with respect thereto, whereby the second brake plate forms a forward guiding surface above the second brake plate and a backward guiding surface below the second brake plate to form a dislocation area between the first brake plate and the forward guiding surface of the second brake plate, a third brake plate extending inwardly from a lower section of the moving rod to form a normal operating area between the backward guiding surface of the second brake plate and the third brake plate, an inwardly extended distance of the first brake plate is defined as W1, an inwardly extended distance of the second brake plate is defined as W2, an inwardly extended distance of the third brake plate is defined as W3, and both W3 and W1 is longer than W2;

the housing having a portion thereof corresponding to an inner side of the moving rod has three inner surfaces with different heights, a first inner surface at an upper end of the housing portion, a third inner surface at a lower end of the housing portion, and a second inner surface located between the first and third inner surfaces, wherein the first inner surface is a V shape concave surface, the second inner surface is a flat surface, and the third surface is a small inclined surface;

the lampshade having a stopping member extending downwardly from an end thereof opposite to the pivot hole;

an elastic leaf arranged above the second terminal and contacting an outside surface of the stopping member for providing the lampshade with an elastic stopping force, whereby the lampshade can be held at a SET position when switched to the SET position, and maintain the moving rod in contact with the third inner surface of the housing portion; and when the lampshade is pressed as ON/OFF switch, the moving rod is driven to rise and fall in an inclined manner, and thereby a curved portion of the lower section of the moving rod moves along the second inner surface and the third inner surface;

a three step switching operation involves the following steps:

a) when the lampshade is pressed to an ON position, the curved portion of the lower section of the moving rod moves along the second inner surface to the third inner surface, causing the backward guiding surface of the second brake plate to push down the movable end of the binary alloy conductive plate and thereby cause the spring leaf to be sprung upwardly and place the first connecting point in contact with the second connecting point to achieve the conducting state;

b) when the lampshade is pressed to an OFF position, the curved portion of the lower section of the moving rod moves along the third inner surface to the second inner surface, causing the third brake plate to pull the movable end of the binary alloy conductive plate upwardly and and thereby cause the spring leaf to be sprung downwardly and displace the first connecting point from contact with the second connecting point to achieve the nonconducting state;

c) when the first connecting point of the binary alloy conductive plate is in contact with the second connecting point to achieve the conducting state, the curved portion of the lower section of the moving rod is located at the third inner surface, and the second brake plate is moved to an outermost position of its travel by an elastic force of the elastic leaf and causing the moving rod to have an angular rotation sufficient for the second brake plate to avoid contact with a position of the movable end of the binary alloy conductive plate, and when an overvoltage occurs, the binary alloy conductive plate will be deformed responsive to an elevated temperature and further to be sprung upward and directly push the first brake plate to displace the moving rod to in turn displace the lampshade to a BREAK status position, with the movable end of the binary alloy conductive plate being located at the dislocation area which between the first brake plate and the second brake plate;

d) subsequent to the lampshade being displaced to the BREAK status position, pressing an OFF end of the lampshade to perform a RESET action and cause the moving rod to move upwardly where the curved portion of the lower section of the moving rod is moved to the first inner surface by the forward guiding surface of the second brake plate being displaced past the movable end of the binary alloy conductive plate to the normal operating area below the second brake plate, whereby the lampshade enables normal switching between the ON and OFF positions.

2. The overload protection switch with a reverse restart switching structure as claimed in claim 1, wherein the elastic leaf includes a main body and an elastic contact end over the main body, and the elastic contact end is arranged to contact the outside surface of the stopping member.

3. The overload protection switch with a reverse restart switching structure as claimed in claim 1, wherein the housing further includes a third terminal.

4. The overload protection switch with a reverse restart switching structure as claimed in claim 1, wherein a bottom of the third brake plate of the moving rod includes an extended pin.

5. The overload protection switch with a reverse restart switching structure as claimed in claim 1, wherein the housing further includes a side cover.

6. The overload protection switch with a reverse restart switching structure as claimed in claim 1, wherein the spring leaf is formed at the movable end of the binary alloy conductive plate and extends from the inner side thereof.

7. The overload protection switch with a reverse restart switching structure as claimed in claim 1, further comprising a neon lamp disposed below the lampshade.

* * * * *